United States Patent [19]

Streeter

[11] Patent Number: 4,466,116

[45] Date of Patent: Aug. 14, 1984

[54] SIGNAL PROCESSOR FOR AM STEREOPHONIC RECEIVING APPARATUS

[75] Inventor: Robert D. Streeter, Fort Wayne, Ind.

[73] Assignee: Magnavox Consumer Electronics Company, Knoxville, Tenn.

[21] Appl. No.: 399,083

[22] Filed: Jul. 16, 1982

[51] Int. Cl.[3] ..... H04H 5/00

[52] U.S. Cl. ..... 381/15; 381/28; 381/94

[58] Field of Search ..... 329/130-135; 381/10, 12, 15, 16, 28, 94, 107, 108, 120, 121

[56] References Cited

U.S. PATENT DOCUMENTS

| | | | |
|---|---|---|---|
| 3,080,453 | 3/1963 | Avins | 381/15 |
| 3,143,600 | 8/1964 | De Vries | 381/15 |
| 3,178,514 | 4/1965 | Holt | 381/15 |
| 4,018,994 | 4/1977 | Kahn | 381/15 |
| 4,159,396 | 6/1979 | Hilbert et al. | 381/15 |
| 4,170,716 | 10/1979 | Hilbert et al. | 381/15 |
| 4,302,626 | 11/1981 | Streeter | 381/15 |
| 4,340,782 | 7/1982 | Weigand et al. | 381/15 |
| 4,373,115 | 2/1983 | Kahn | 381/15 |

OTHER PUBLICATIONS

Comments of Magnavox Consumer Electronics Company to FCC re Docket No. 21313, Feb. 9, 1981, pp. IV-21 to IV-23.

Reply Comments of Magnavox Consumer Electronics Company to FCC re Docket No. 21313, Mar. 1981, pp. 3-9.

*Primary Examiner*—A. D. Pellinen

*Attorney, Agent, or Firm*—Pollock, Vande Sande & Priddy

[57] ABSTRACT

A circuit for processing an angle modulated signal having amplitude modulation signal components in stereophonic broadcasting systems. An inverse modulation of a signal to be detected is provided over a first signal amplitude range, and a constant signal level is provided over a remaining range for signals having a marginal amplitude level. The discontinuity in the control range avoids noise expansion for high negative amplitude modulator levels for the signal to be angle modulated.

11 Claims, 6 Drawing Figures

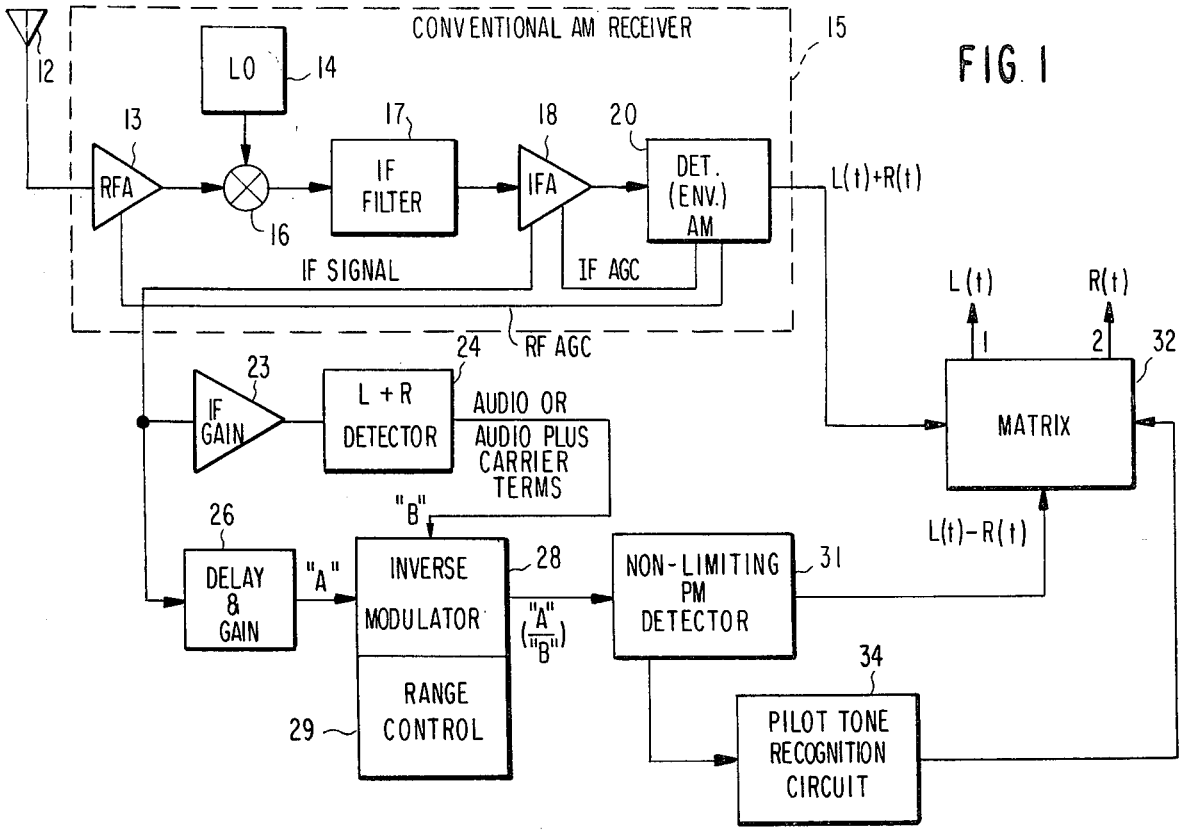
FIG. 1
FIG. 5
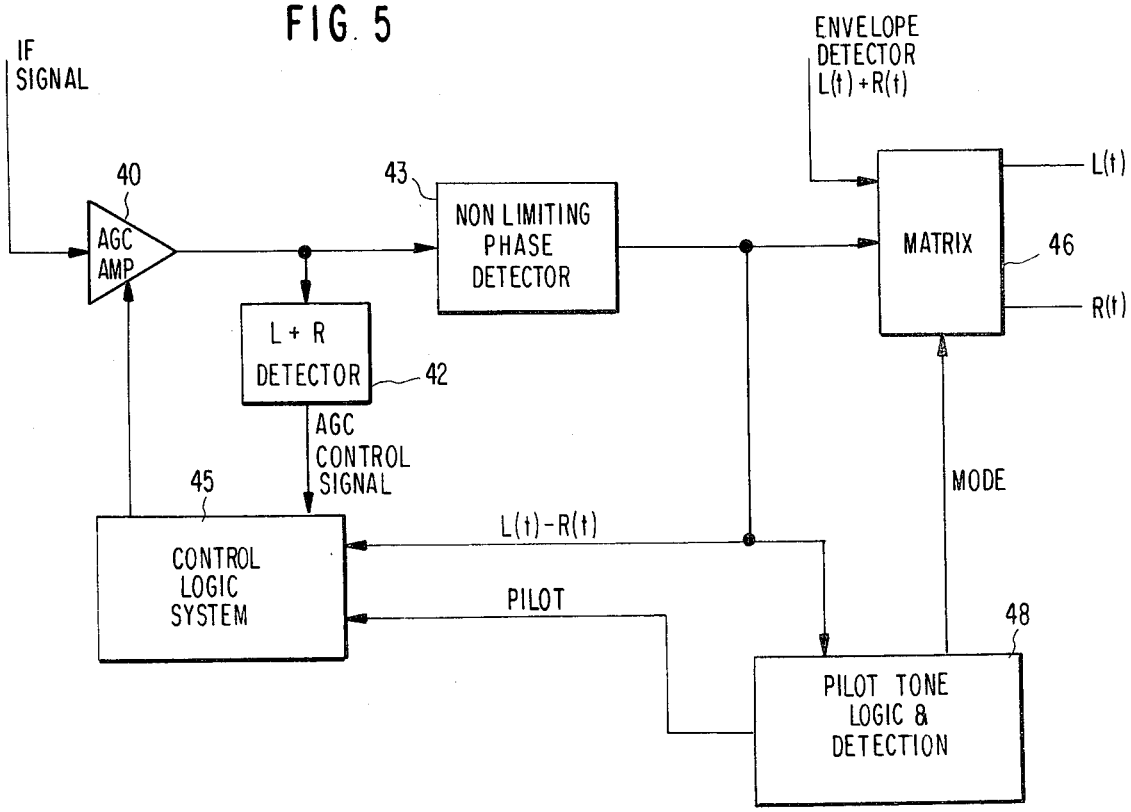

$$[1+L(t)+R(t)]\cos[w_{if}t+B(L(t)-R(t)+A_0\cos w_0 t]$$

SIGNAL PROCESSOR FOR AM STEREOPHONIC RECEIVING APPARATUS

BACKGROUND OF THE INVENTION

The present invention relates to the art of transmitting and receiving stereophonic information on a single radio frequency signal. Specifically, a signal processing circuit for an intermediate frequency signal containing both amplitude modulation and angle modulation components is described.

A system for transmitting stereophonic related signals on the portion of the radio frequency spectrum reserved for low frequency amplitude modulation broadcast has been determined to be in the public interest by the Federal Communications Commission. Several proposals have been suggested all of which include transmitting as amplitude modulation on an R.F. carrier the summation of stereophonic related signals. A difference signal formed from the stereophonic related signals angle modulates the RF carrier, which when demodulated is combined with the amplitude demodulated signal to form first and second stereophonic signals.

The demodulation of the angularly modulated difference signal has been complicated by the presence of amplitude modulation on the signal. In the case of high negative amplitude modulation peaks, the angle demodulator is presented with a zero signal level, or marginal signal level, which when detected by the angle demodulator, can under certain signal conditions produce a noise burst.

Various techniques have been proposed for elimination or reducing the consequences of a temporary loss in signal amplitude. These include a sample and hold technique as disclosed in U.S. Pat. No. 4,340,782, and a regenerative I.F. circuit for introducing a substitute signal during those periods of signal loss as disclosed in U.S. patent application Ser. No. 159,359, filed June 13, 1980, in the name of Laurel R. Lind.

The present invention is yet another technique for minimizing the noise burst without introducing undesirable distortion products to the difference signal.

SUMMARY OF THE INVENTION

It is an object of this invention to provide protection to an angle demodulation circuit against the generation of noise under low level input signal conditions.

This and other objects of the invention are carried out by an apparatus which limits the amplitude excusions of a signal to be angle demodulated in response to a sensed condition which indicates a low level of noise to be present on the signal. In the absence of this condition, the amplitude excusions of the signal are uncontrolled during demodulation.

In one embodiment of the invention a circuit is provided which conditions a signal containing angle modulation components by inversely amplitude modulating the signal when the signal has an amplitude level in excess of a predetermined minimum, indicating a low noise level. For input signal conditions below this level, the signal passes through the inverse modulator unaltered.

The avoidance of the inverse modulation at low signal levels avoids the enhancement of noise which occurs at these low amplitude levels. The subsequent demodulation of the signal takes place without an objectionable noise burst.

In one embodiment of the invention, an inverse amplitude modulator is employed having a gain vs control voltage function which is linear over a first portion of its range, and constant over another portion of its range. The second constant gain portion passes the signal to an angle demodulator without altering the signal, while the first linearly variable gain portion passes the signal to an angle demodulator with the majority of the envelope modulation removed. Expansion of the noise present with the marginal amplitude signal is therefore avoided.

Other embodiments of the invention employ as additional controls to the inverse modulation of the signal the detection of an output signal from the demodulator for disabling the inverse modulator. Where a stereophonic indicating signal is included with the transmitted carrier, this signal may also be used to enable the inverse modulator thus avoiding unnecessarily amplitude modulating a signal which contains no angle modulation components.

DESCRIPTION OF THE FIGURES

FIG. 1 is a schematic drawing of a first embodiment of the invention.

FIG. 5 is a block diagram of yet another embodiment of the invention.

DESCRIPTION OF THE PREFERRED EMBODIMENT

Figure 2:
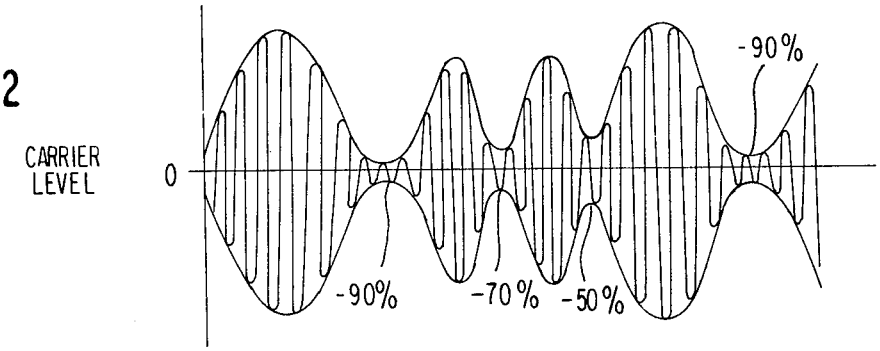
FIG. 2 is a typical radio frequency signal modulated in amplitude and angle with stereophonic broadcast information.

Referring now to FIG. 1, there is shown a AM radio receiver adapted to detect stereophonic broadcasts. The receiver shown is particularly suitable for demodulating the broadcast signal proposed by the Magnavox Consumer Electronics Company, which contains amplitude modulation components comprising a summation of stereophonic related signals and linear phase modulation components comprising the difference signal of the stereophonic related signals, L(t) and R(t). Antenna 12 supplies the radiated signal to a conventional RF amplifier 13. The RF amplifier 13 signal is supplied to mixer 16 wherein an intermediate frequency signal is produced as a result of the mixing action with the local oscillator 14 output signal. An IF filter 17 provides the intermediate frequency signal to the IF amplifier 18. An envelope detector 20 provides both AGC control for the IF amplifier 18, and RF amplifier 13 as well as a detected envelope component L(t)+R(t) representing the summation signal modulated on the RF carrier. The circuitry shown within 15 is conventional to monophonic AM receivers of present design.

The demodulation of the linear phase modulation components contained on the signal is accomplished by conditioning the intermediate frequency signal from IF amplifier 18 in a manner which will produce a minimum of distortion to the difference signal, L(t)−R(t), and which will avoid the unnecessary introduction of noise during signal conditions which produce a minimum amplitude level for phase detecting.

Referring to FIG. 2, there is shown an example of an intermediate frequency signal produced in response to the aforesaid radio frequency carrier signal received by antenna 12. The signal is shown to contain amplitude modulation peaks and valleys, the lower peaks of −90% being representative of a marginal signal which may with some types of angle demodulators produce objectionable noise bursts. Further, it is desirable to remove the amplitude perturbations before phase detecting the signal so that the output of the phase detector is substantially free of any influence of the amplitude modulation to provide a true representative difference signal L(t)−R(t).

In order to avoid the effects of the higher negative amplitude modulation peaks, an inverse modulator 28 is provided which can be an AGC amplifier, operated open loop, having a control input connected to the L(t)+R(t) detector 24. L(t)+R(t) detector 24 is a AM envelope detector which removes the amplitude modulation envelope and provides a signal proportional to the audio components or the audio and remaining demodulated components of the amplitude modulation function. An amplifier 23 supplies the intermediate frequency signal to the L(t)+R(t) detector 24.

Figure 4:
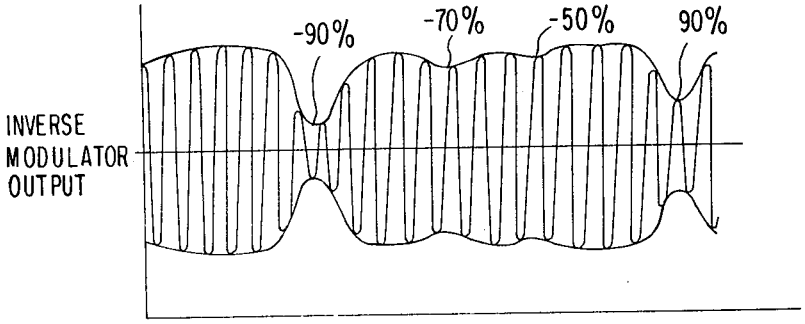
FIG. 4 is an illustration of the amplitude envelope of the signal of FIG. 2 processed by the circuit of FIG. 1.

Under the control of the inverse modulator 28 the IF signal is inversely modulated to provide an essential constant amplitude signal over a major portion of the signal. However, there is a range control associated with the inverse modulator which will clamp the inverse modulator at a constant gain for amplitude levels which are below a predetermined minimum. As an example of this range control, there is provided a control voltage versus gain relationship for the inverse modulator 28, which may be the aforesaid automatic gain control amplifier, wherein negative peak modulation excursions exceeding 70% do not provide a corresponding increase in gain for the automatic gain controlled amplifier and therefore pass through the inverse modulator 28 unaltered. Referring to FIG. 4, the effect of the range control 29 can be seen on the signal provided by the AGC amplifier used as the inverse modulator 28. The high negative peaks corresponding to 90% modulation levels remain in the signal and are presented to a nonlimiting type of phase modulation detector 31 for demodulating the difference signal contained therein. The phase demodulation detector 31 supplies the difference signal to a matrix 32 where it is combined with a summation, envelope modulated signal L(t)+R(t) provided by detector 20 to derive the stereophonic related signals L(t) and R(t). In those systems such as the Magnavox sponsored AM stereophonic broadcasting system which utilize an identifying tone with the broadcasts to identify the broadcast as stereophonic, an identification detector 34, such as is shown in U.S. Pat. No. 4,302,626, is provided to control the matrix 32 such that during nonstereophonic broadcasts, the envelope signal comprising the summation of L(t)+R(t) is provided as first and second outputs of the matrix.

Using the circuit of FIG. 1, the AGC amplifier output signal having a controlled modulation envelope produces a PM detected difference signal which is amplitude normalized over a major portion of the signal. By controlling the inverse modulator 28 to halt the correction modulation of high negative peak conditions when a marginal signal amplitude is presented for phase detection, the noise accompanying the marginal signal level is not expanded to produce an objectional noise burst from the phase modulation detector 31. The result of the clamping of the inverse modulation at a particular modulation depth of 70% may be the production of distortion in the detected signal, however, the distortion produced is not objectionable to listeners when the difference signal is matrixed with the summation signal to produce the respective stereophonic related signals. Thus, the benefits of amplitude normalizing the intermediate frequency signal before phase detecting the same are realized without the unnecessary expansion of the noise accompanying the low amplitude level portions of the intermediate frequency signal.

Figure 3:
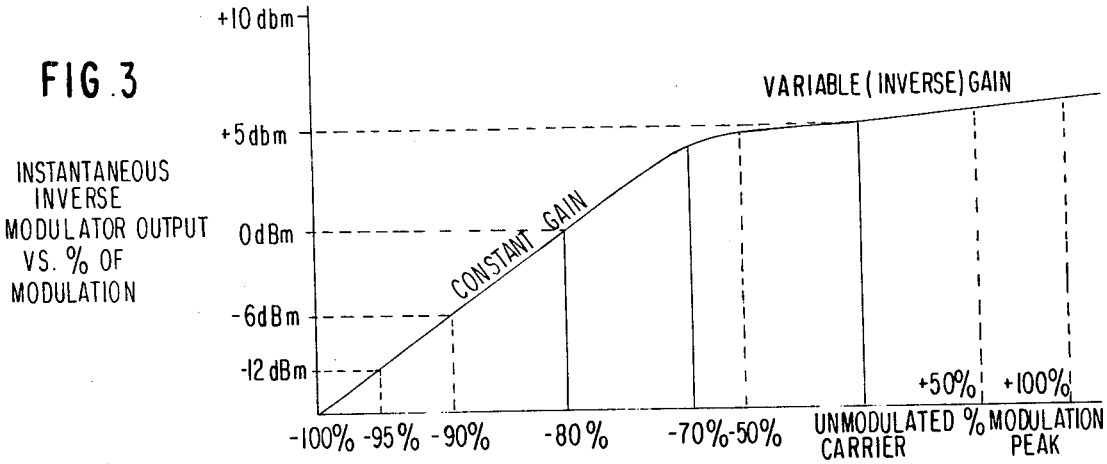
FIG. 3 is a possible output VS input characteristic for an inverse modulator.

The operation of the inverse modulator is shown more particularly in FIG. 3. As previously mentioned, the inverse modulator 28 and associated range control circuitry 29 may take the form of an automatic gain amplifier having a control input connected to receive a signal corresponding to the detected envelope function from detector 24. FIG. 3 demonstrates a constant gain for negative modulation peaks between −70%, and −100% the signal levels greater than −70% thereafter passing through at a substantially constant signal amplitude. The automatic gain controlled amplifier control voltage response therefore has a breakpoint selected to be at the minus 70% modulation input level. A delay and gain circuit 26 is used to normalize the signal amplitude entering the inverse modulator 28 so that the modulation signal B tracks closely the amplitude changes in signal A. Those skilled in the art will recognize that automatic gain control can be provided having a breakpoint shown in FIG. 3 to provide a flat minimum gain increase beyond a selected control voltage.

Figure 6:
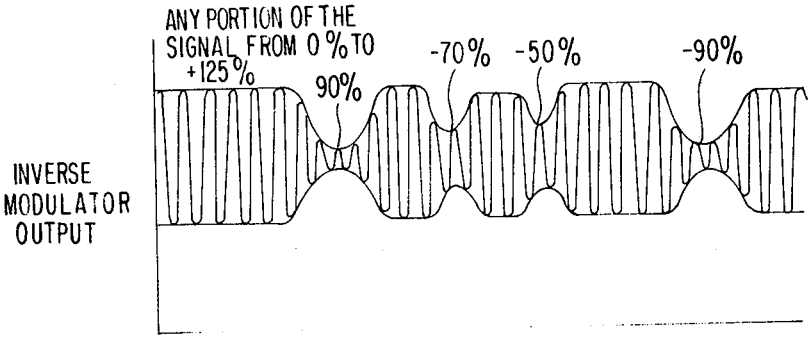
FIG. 6, is an illustration of the amplitude envelope of the signal of FIG. 2 processed by the circuit of FIG. 5.

Referring to FIG. 5, there is shown an additional embodiment of a circuit for implementing the present invention utilizing a closed loop control. In the embodiment of FIG. 5, an automatic gain control amplifier 40 receives the intermediate frequency signal of FIG. 2. The amplitude function of the IF signal is detected for envelope amplitude of the signal by detector 42. The control logic system 45 provides a control voltage to AGC amplifier 40 only under conditions of positive modulation of the intermediate frequency signal, clamping the automatic gain control amplifier 40 at a fixed gain during the low instantaneous levels due to negative modulation. As FIG. 6 shows, the positive peak amplitude levels of the signal will be clamped at a substantially fixed level, whereby all negative peaks may pass through without being inversely modulated. Detecting this signal with a suitable phase detector 43 will provide the advantages of a substantially amplitude constant signal during positive amplitude excursions, while avoiding the expansion of the detected noise during negative amplitude excursions.

Of course, the control logic system 45 may be configured to pass only certain negative peaks below a minimum signal level, while expanding other negative peaks to approach the effect of the system of FIG. 1.

As an additional feature of the embodiment of FIG. 5, both L(t)−R(t) and identification signal detection may be used to control the automatic gain control amplifier 40. The pilot tone detector 48 will sense the presence or absence of a stereophonic broadcast, and control the matrix 46 as well as the automatic gain control amplifier 40 such that no inverse modulation will take place unless a stereophonic broadcast is being received. Further, in the event the L(t)−R(t) signal is below a minimum threshold, the AGC amplifier 40 can be controlled to avoid any gain expansion of noise present. By sensing the difference signal from the phase modulation detector 43, it is possible to inverse modulate when a difference signal is being detected but avoid the noise expansion in the event the difference signal is zero level or a marginal amplitude level.

Of coures, the control logic system 45 may be configured to pass a signal bearing information unaltered under a variety of circumstances. It may pass information for all but very deep negative amplitude peaks, simulating the behavior of the circuit of FIG. 1. It may control on positive amplitude peaks only, allowing all negative peaks to pass through uncorrected. It may control based on the strength of the received signal as well as a function of the modulation depth of the signal. The control threshold may also be based on the magnitude of the L(t)−R(t) signal which is present on positive modulation peaks, when the nonlimiting phase detector is operating properly due to the inverse modulation.

With center channel stereophonic material, there is no L(t)−R(t) information, and there is no need to operate the inverse modulator. As the stereophonic information increases, the L(t)−R(t) signal will increase, with the additional need to inverse modulate the incoming IF signal prior to the nonlimiting phase detection. Thus, the appropriate control logic could recognize the need or absence of inverse modulation, and control the AGC amplifier appropriately to avoid fluctuation in the L−R noise floor caused by the envelope modulation when there was little L−R to be detected. A noise detector could also be a part of the control logic, reducing the correction for large noise levels.

It should be noted that the control system of FIG. 5 is a closed-loop envelope corrector, while the system of FIG. 1 is an open-loop system. It is also worth noting that the characteristics of FIG. 3 could also be obtained with a limiter, whose "knee of limiting" corresponds to, for example, −70% envelope modulation.

Thus, there is shown with respect to two embodiments, circuitry for processing the angular modulation components contained in a stereophonic signal having an amplitude modulation function. Those skilled in the art will recognize yet other embodiments described more particularly by the claims which follows.

What is claimed is:

1. In a receiver system for removing stereophonic sound information contained as a summation signal L(t)+R(t) modulating the amplitude of an RF carrier signal, and as a difference signal L(t)−R(t) angularly modulating said RF carrier signal, a signal processing circuit comprising:

means for converting said modulated RF carrier signal into an intermediate frequency signal;

a variable gain amplifier connected to receive said intermediate frequency signal, said amplifier being gain responsive to a control voltage for providing an inverse change in gain over a first control range, and a substantially fixed gain over a second control range;

an angle demodulator connected to said variable gain amplifier for receiving said intermediate frequency signal and providing a signal proportional to said L(t)−R(t) signal; and an amplitude modulation detector connected to provide a control voltage signal proportional to L(t)+R(t) to said variable gain amplifier, whereby during a first portion of said L(t)+R(t) signal said gain changes and over a second portion of said L(t)+R(t) signal remains the same, limiting increases of noise being detected by said angle modulator.

2. In a receiving system for removing stereophonic signals R(t), and L(t) from a R.F. carrier signal, said R.F. carrier signal being modulated in amplitude by a summation signal R(t)+ L(t), and in angle by a difference signal L(t)−L(t), a signal processing circuit comprising;

means for converting said rf carrier signal to an intermediate frequency signal;

means for providing a signal representing the amplitude of said intermediate frequency signal;

means for normalizing the amplitude of said intermediate frequency signal in response to said signal representing said amplitude, said means for normalizing inversely modulating said intermediate frequency signal when said intermediate frequency signal is above a predetermined level, and a substantially constant amplification to said intermediate frequency signal when said intermediate frequency signal is below said predetermined level; and an angle demodulator connected to receive a signal from said means for normalizing, said angle demodulator producing a signal proportional to L(t)−R(t).

3. The circuit of claim 2, wherein said predetermined level corresponds to an 80% peak negative amplitude modulation level.

4. The circuit of claim 2, wherein said predetermined level is selected within the range of 50 to 90% peak negative amplitude modulation on said intermediate frequency signal.

5. The circuit of claim 2 further comprising an amplitude detector connected to receive said intermediate frequency signal, said detector providing a signal proportional to said L(t)+R(t) summation signal.

6. In a receiver system for removing stereophonic sound information contained as a summation signal L(t)+R(t) amplitude modulated on an RF carrier signal, and as a difference signal L(t)−R(t) angularly modulating said carrier signal, a signal processing circuit comprising:

means for converting said RF carrier signal into an intermediate frequency signal;

an automatic gain control amplifier for receiving said intermediate frequency signal, said amplifier having a control input for receiving a control voltage;

an amplitude detector means connected to the output of said amplifier and to said control input, said detector means and automatic gain control amplifier during positive modulation peaks amplitude normalizing said amplifier output signal, and during negative modulation peaks providing an output signal without amplitude normalization whereby said amplifier during negative peak modulation peaks limits the contributions of noise to said amplifier output signal.

7. The circuit of claim 6 further comprising:

an angle modulation detector connected to receive a signal from said amplifier and provide a signal proportional to said difference signal L(t)−R(t);

a detector for detecting the absence of a signal from said angle modulation detector; and means for inhibiting a gain change in said amplifier when said detector indicates the absence of a signal from said angle modulation detector.

8. The circuit of claim 7 further including:

means for detecting the absence of a stereophonic indicating signal transmitted with said RF carrier signal; and means for inhibiting a gain change in said amplifier in response to the detection of an absence of said stereophonic indicating signal.

9. In a system for AM stereophonic broadcasting wherein an R.F. signal carrier containing both amplitude and angular modulation components is processed to derive first and second stereophonic related signals, a circuit for conditioning said carrier signal for angle demodulation comprising:

means for deriving a signal from said carrier signal representing the amplitude modulation of said R.F. signal carrier;

means for inversely modulating said R.F. signal carrier in response to said signal from said means for deriving a representative signal when said carrier signal is above a predetermined level, and for passing said signal unmodulated for signal levels below said predetermined level.

10. In a system of stereophonic broadcasting wherein a summation signal amplitude modulates said broadcast signal, and a difference signal angularly modulates said broadcast signal, a circuit for processing said broadcast signal comprising:

means for converting said broadcast signal into an intermediate frequency signal;

means for limiting amplitude excursions of said intermediate frequency signal in response to a sensed signal condition, and for permitting said amplitude excursions in the absence of said sensed condition; and means for detecting angle modulation components from a signal supplied by said means for limiting whereby a signal is produced proportional to said difference signal having a noise component controlled in response to said sensed condition.

11. The system of claim 10, wherein said sensed condition is the amplitude level of said broadcast signal.

* * * * *